US007713081B2

(12) United States Patent
Chen

(10) Patent No.: US 7,713,081 B2
(45) Date of Patent: May 11, 2010

(54) COMMUNICATION JACK

(75) Inventor: Chou-Hsing Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 12/184,887

(22) Filed: Aug. 1, 2008

(65) Prior Publication Data

US 2009/0311904 A1 Dec. 17, 2009

(30) Foreign Application Priority Data

Jun. 11, 2008 (TW) ..... 97210345 U

(51) Int. Cl.
*H01R 13/58* (2006.01)

(52) U.S. Cl. ..... 439/468; 439/409

(58) Field of Classification Search ..... 439/409, 439/467–469, 96–98, 607.41–52
See application file for complete search history.

(56) References Cited

U.S. PATENT DOCUMENTS

| | | | | |
|---|---|---|---|---|
| 4,169,648 | A * | 10/1979 | Moist, Jr. | 439/467 |
| 4,619,494 | A | 10/1986 | Noorily et al. | |
| 5,315,063 | A * | 5/1994 | Auclair | 174/78 |
| 5,514,007 | A | 5/1996 | Rodrigues | |
| 5,957,720 | A * | 9/1999 | Boudin | 439/417 |
| 6,126,478 | A * | 10/2000 | Presson et al. | 439/467 |
| 6,200,157 | B1 * | 3/2001 | Ams et al. | 439/409 |
| 6,238,233 | B1 * | 5/2001 | Drexler et al. | 439/409 |
| 6,371,794 | B1 | 4/2002 | Bauer et al. | |
| 6,485,335 | B1 * | 11/2002 | Dewdney | 439/607.5 |
| 6,595,789 | B2 * | 7/2003 | Oota et al. | 439/98 |
| 6,663,411 | B2 * | 12/2003 | Little | 439/352 |
| 6,783,386 | B2 * | 8/2004 | Clement | 439/467 |
| 6,902,423 | B2 * | 6/2005 | Castaldo et al. | 439/467 |
| 2005/0164543 | A1 * | 7/2005 | Dang | 439/468 |
| 2005/0239322 | A1 * | 10/2005 | Godefroy et al. | 439/409 |
| 2008/0096420 | A1 | 4/2008 | Zeng | |

FOREIGN PATENT DOCUMENTS

| | | |
|---|---|---|
| EP | 1 710 874 A2 | 10/2006 |
| WO | 2008/027326 A2 | 3/2008 |

OTHER PUBLICATIONS

European Patent Office; Search Report in foreign application (EP 08161453.9-1231) related to Taiwan application 097210345 to which priority is claimed by the present application; Nov. 13, 2009.

* cited by examiner

*Primary Examiner*—Edwin A. Leon
*Assistant Examiner*—Larisa Tsukerman
(74) *Attorney, Agent, or Firm*—Workman Nydegger

(57) ABSTRACT

A communication is jack adapted to connect a cable that has an exposed ground wire mesh. The communication jack includes a first member, a second member, and a clamping component. The second member and the first member are capable of pivotally rotating relatively to be combined to form a clamping area. The cable is gripped by the clamping component and the second member in the clamping area, and the clamping component and the second member keep in contact with the ground wire mesh of the cable. Thus, the cable is fixed and grounded by simply combining the first and second members.

9 Claims, 12 Drawing Sheets

COMMUNICATION JACK

CROSS-REFERENCE TO RELATED APPLICATIONS

This non-provisional application claims priority under 35 U.S.C.§119(a) on Patent Application No(s). 097210345 filed in Taiwan, R.O.C. on Jun. 11, 2008 the entire contents of which are hereby incorporated by reference.

BACKGROUND OF THE INVENTION

1. Field of Invention

The present invention relates to an electric signal connector, and in particularly, to a communication jack capable of fixing and grounding a cable at the same time.

2. Related Art

Connectors are basic parts commonly seen in the electrocommunication field, and almost various electronic devices are installed with connectors serving as the medium for connecting the electronic devices to an external electric signal. Among various types of connectors, some can be directly inserted with a cable (for example, a network line or telephone line) so as to be electrically connected thereto, and this kind of connector is referred to as a communication jack for connecting cables of two different interfaces.

Referring to FIG. 1, a common network or telecommunication jack is shown. The jack mainly includes a jack body 10, a wire harness cap (not shown), and two covers 12. One side of the jack body 10 is provided for insertion of a cable 14 with a plug, and the other side is connected to a cable 15 with exposed wires. The cable 15 is electrically connected to the cable 14 through IDC terminals and contact terminals electrically connected to an inner case of the jack body 10. The cable 15 is formed by a plurality of wires and a woven wire mesh 151 wrapped around the wires. In addition, the wires are arranged on the wire harness cap, and the woven wire mesh 151 is usually uncovered on the surface of the cable 15 during the layout. The covers 12 press the wire harness cap, so as to extrude the wires of the cable 15 into the IDC terminals to complete the electrical connection. The cover 12 has a ground ring 13 corresponding to the cable 15, and the cable 15 is tightly bound to the ground ring 13 by a strap 16. Thus, the cable 15 is fixed to the covers 12, and meanwhile the ground ring 13 keeps in close contact with the woven wire mesh 151 of the cable 15, so as to achieve grounding through the covers 12 and the jack body 10.

However, in the communication jack of FIG. 1, an additional accessory (i.e., the strap 16) independent from the communication jack is used to complete the fixing and grounding operation. Thus, the strap 16 must be attached to the communication jack when shipped and sold, so the number of separate parts is increased. The increase of the parts will result in the increase of complexity of assembling the communication jack and the cable 15, and cost more labor hours. Besides, the additional parts may easily fall apart or get lost, thus resulting in inconvenience in assembly. Further, the strap 16, exposed out of the communication jack without any protection, may easily be damaged under an external force, which further results in the loss of the grounding and fixing effects. In addition, usually, the strap 16 can be used only once. Moreover, in order to install the strap 16, an operating space must be reserved on the periphery of the communication jack, so the strap 16 is inapplicable to the communication jack in an electronic device with a limited inner space.

SUMMARY OF THE INVENTION

In the communication jack of the prior art, the parts for fixing and grounding a cable are separated from the jack, so that the assembly is inconvenient and easily cause damages. Thereby, in order to solve the problems in the prior art, the present invention is directed to a communication jack with the parts for fixing and grounding a cable integrated therein.

A communication jack adapted to connect a cable is provided. The cable has a ground wire mesh laid on a surface of the cable from inner to outer. The communication jack includes a first member, a second member, and a clamping component. The first member has an operating slot, and the second member is movably assembled with the first member. Further, the second member and the first member pivotally rotate relatively so as to be combined together, thus forming a clamping area corresponding to the operating slot. The cable passes through the clamping area and extends to a place between the first member and the second member. The clamping component is displacedly disposed in the operating slot of the first member, and normally extends into the clamping area to press against the cable, such that the first member and the second member grip the cable together and keep in contact with the ground wire mesh. Therefore, as long as the first member is combined with the second member, the cable can be fixed and grounded through the two members.

The present invention has the following effects. As long as the first member is combined with the second member, the cable can be fixed and grounded, thus simplifying the assembly process, reducing the labor hours, and saving the operating space. Besides, as the clamping component is integrated inside the communication jack, the first member and the second member may provide certain protections to resist external forces. Thus, the additional parts can be reduced, and the problems that the parts fall apart or get lost can be solved.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The objectives, structures, features, and functions of the present invention will be illustrated in detail below in the accompanying embodiments.

Figure 1:
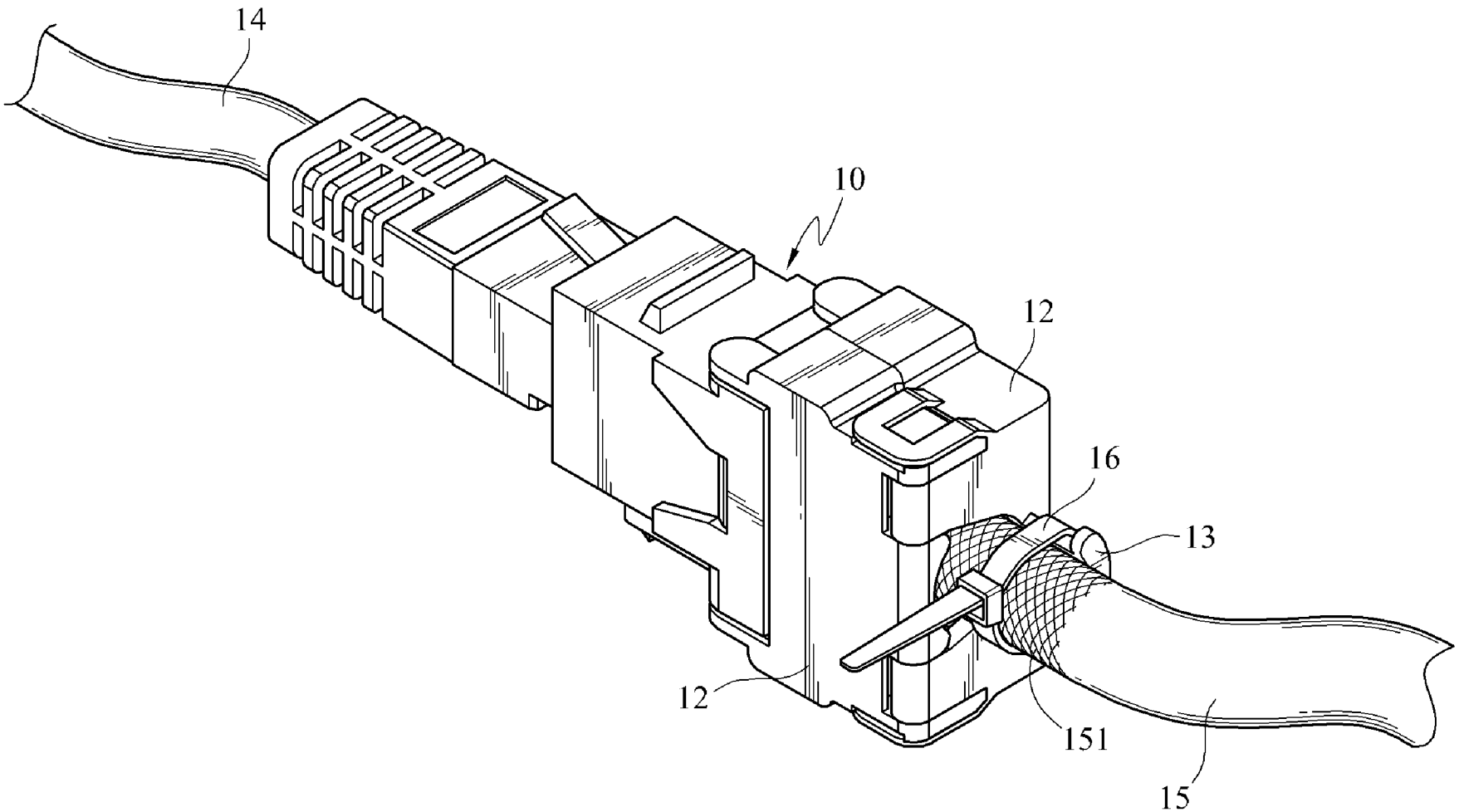
FIG.1 (Prior Art)
FIG. 1 is a schematic combined view of a signal jack and cables in the prior art.
Figure 2:
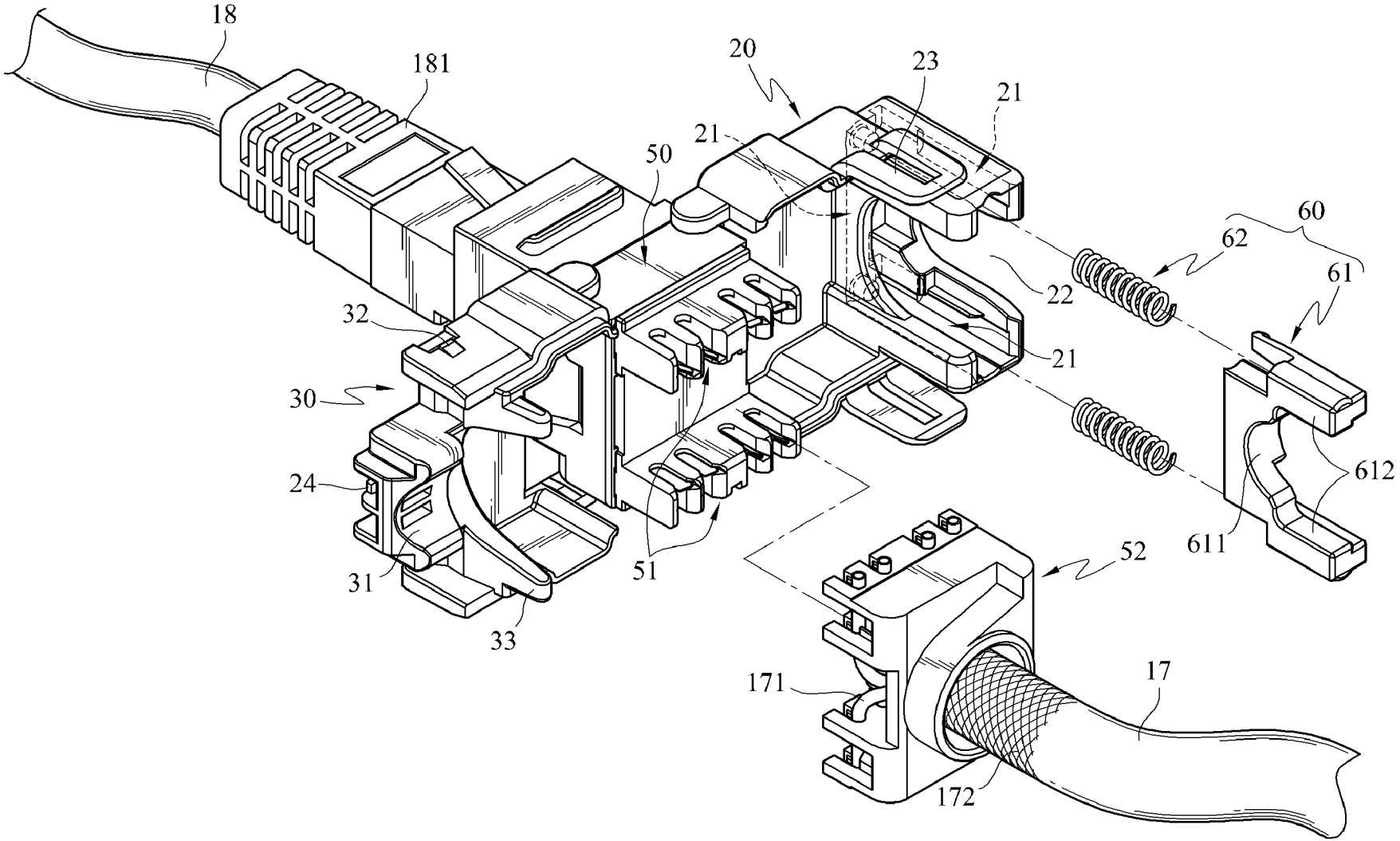
FIG. 2 is a three-dimensional exploded view of a signal jack and cables according to a first embodiment of the present invention.
Figure 3:
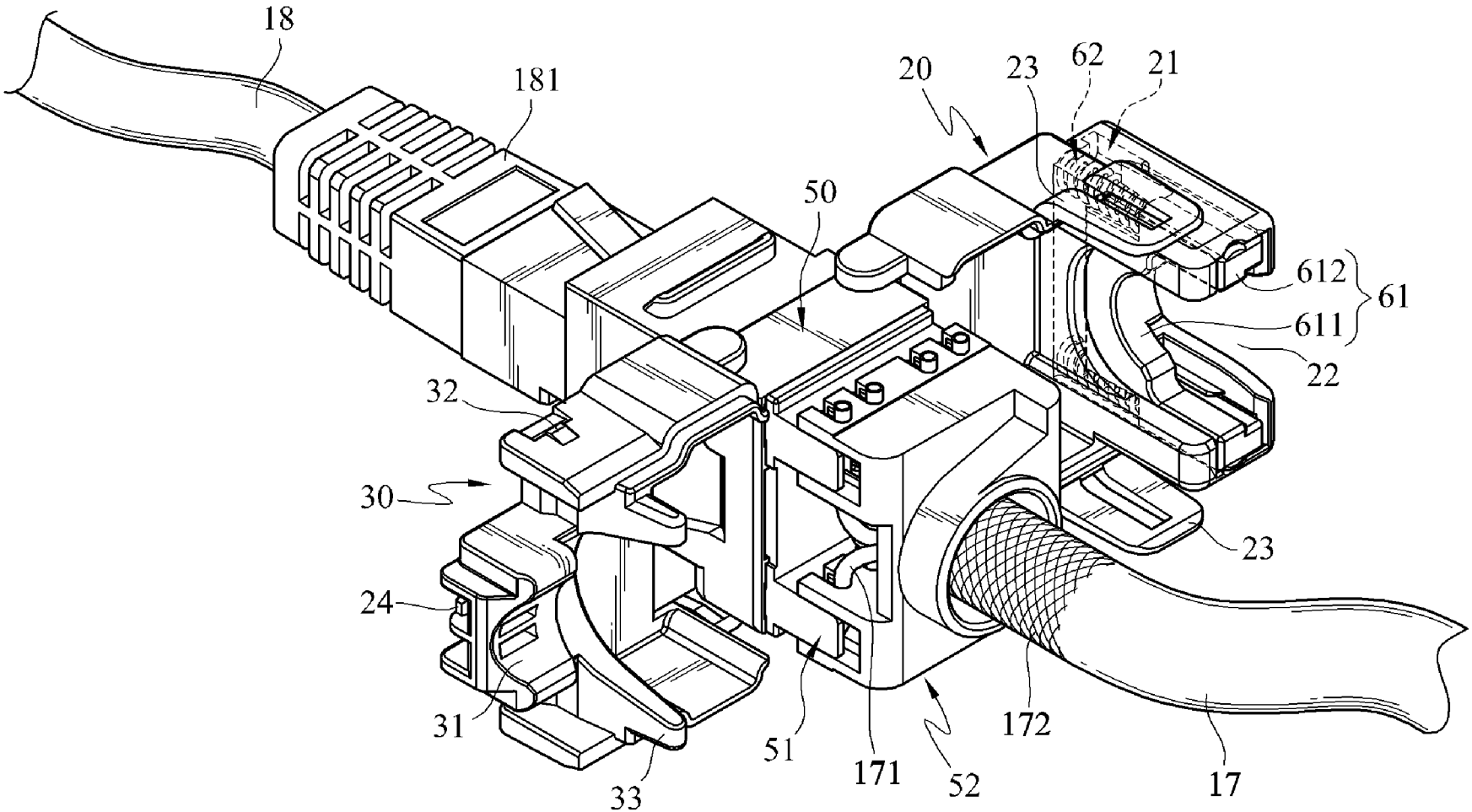
FIG. 3 is a three-dimensional assembly view of the signal jack and cables according to the first embodiment of the present invention.
Figure 4:
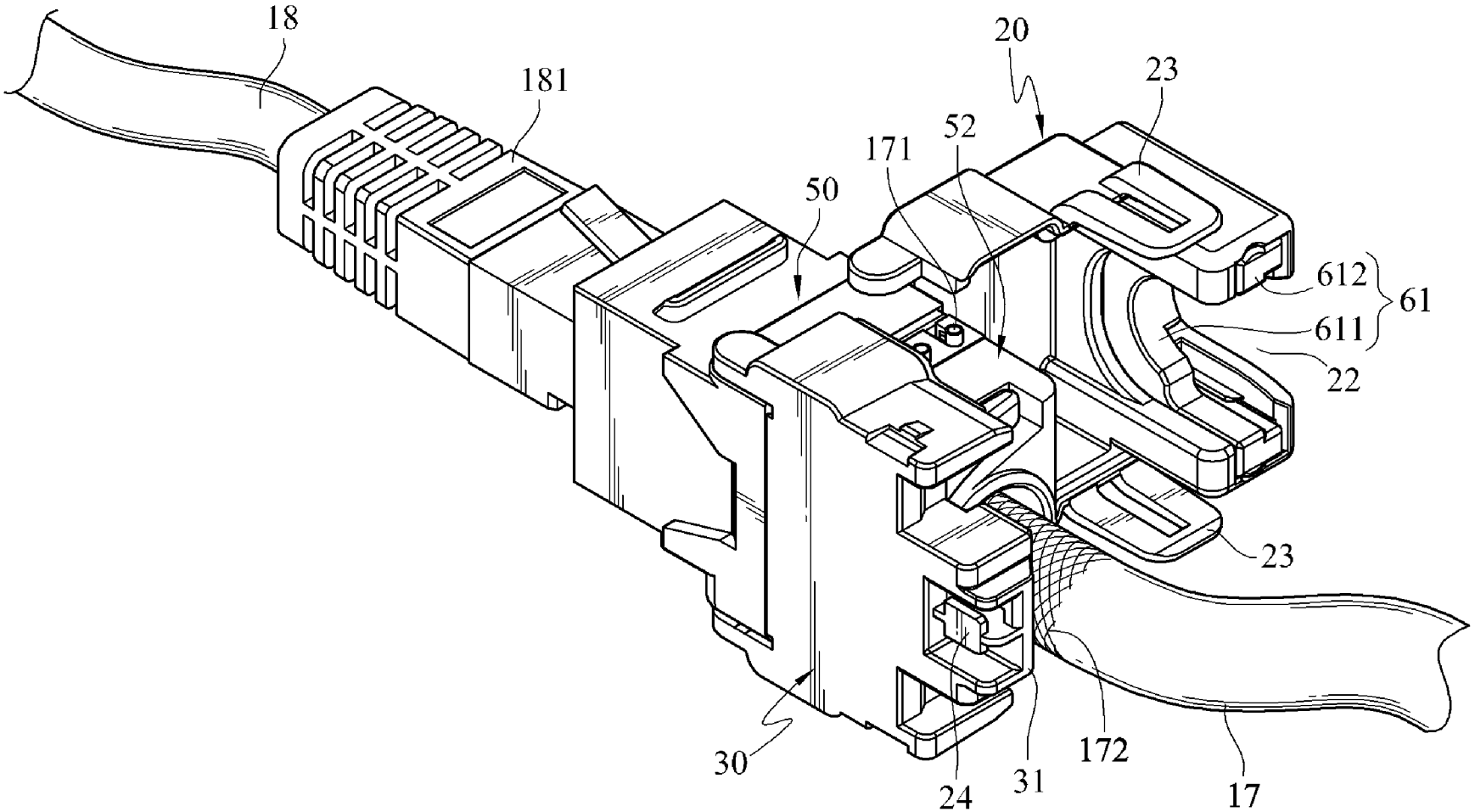
FIG. 4 is a three-dimensional assembly view of the signal jack and cables according to the first embodiment of the present invention.
Figure 5:
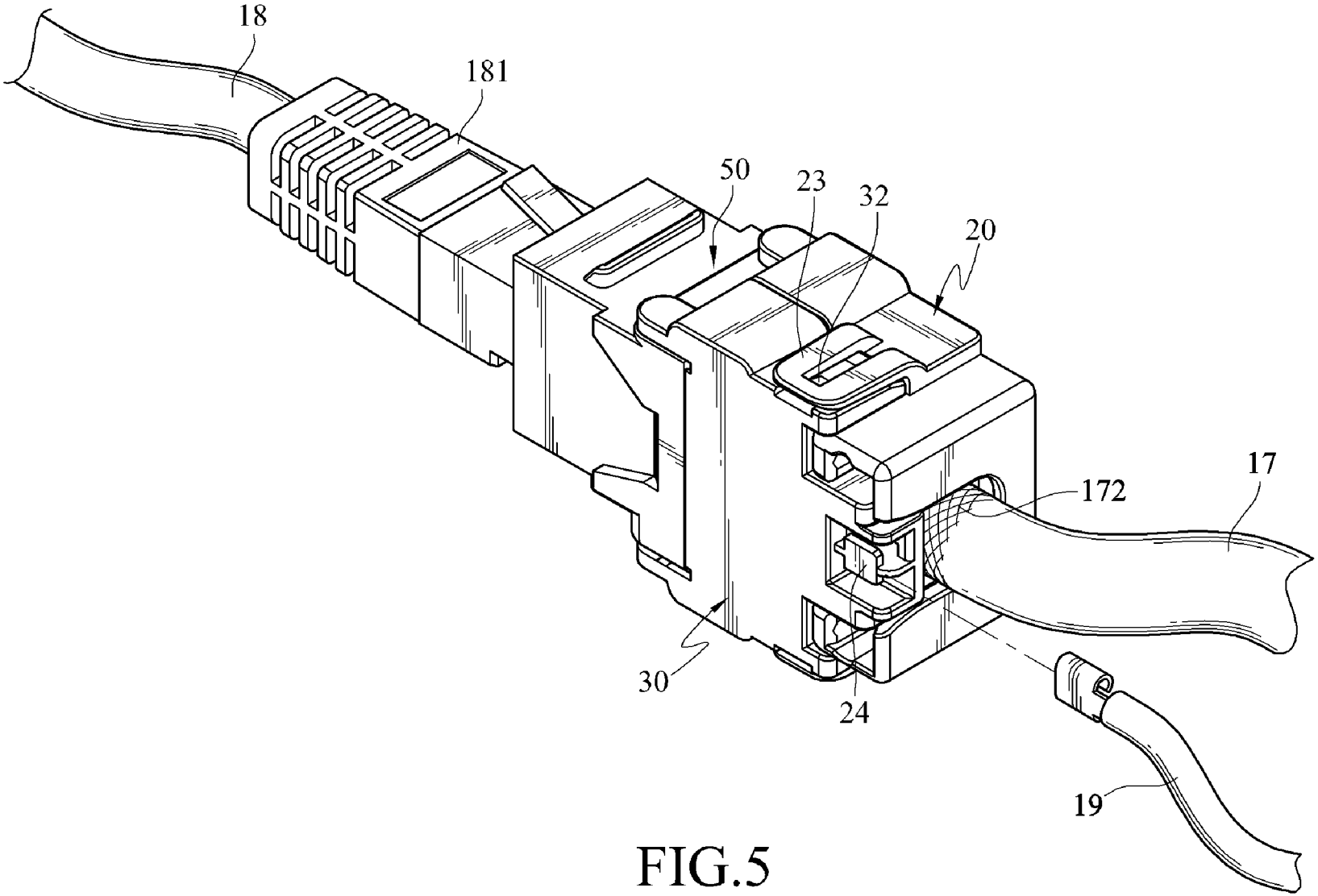
FIG. 5 is a three-dimensional combined view of the signal jack and cables according to the first embodiment of the present invention.
Figure 6:
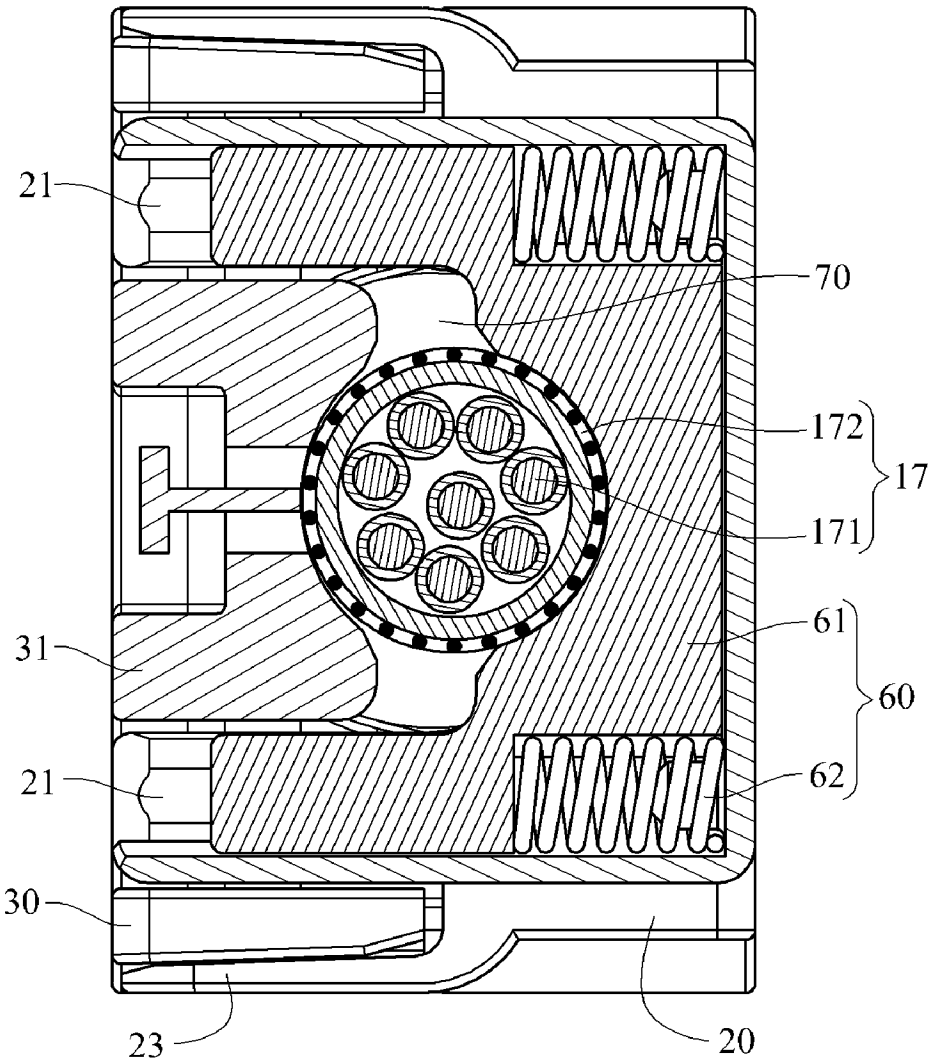
FIG. 6 is a schematic cross-sectional view of the signal jack and cables according to the first embodiment of the present invention.

Referring to FIGS. 2 to 6, a first embodiment of the present invention is shown. According to the first embodiment of the present invention, a communication jack electrically connects a cable 17 and a cable 18. The communication jack of this embodiment includes a first member 20, a second member 30, a base 50, and a clamping component 60, which are all made of a conductive material, such as copper, iron, aluminum, or other metal materials.

The cable 18 is a network or telecommunication connection line with an adapter 181 on the front end. The cable 17 has a plurality of wires 171 and a layer of ground wire mesh 172 wrapped around the wires 171. The ground wire mesh 172 is woven, for grounding and isolating the cable 17 from external signal interferences. During the layout, the front end of the cable 17 is cut open to expose the wires 171 and the ground wire mesh 172. Afterward, the exposed ground wire mesh 172 is lifted outward to be laid on the outer surface of the cable 17 for grounding.

Referring to FIGS. 2, 3, 4, and 5, the front end of the base 50 is inserted by the adapter 181 of the cable 18, and the rear end is provided with a piercing terminal block 51 divided into two parts. The piercing terminal block 51 has a plurality of insulation displacement connection terminals (IDC terminals) each electrically connected to a contact terminal (not shown). After being inserted in the base 50 with the adapter 181, the cable 18 is able to electrically contact the contact terminals, so as to be electrically connected to the IDC terminals on the piercing terminal block 51 through the contact terminals. In addition, the base 50 further includes a terminal pressing member 52. The front end of the cable 17 passes through the terminal pressing member 52, and the exposed wires 171 are respectively disposed on the terminal pressing member 52 (i.e., inserted in notches of the terminal pressing member 52).

The first member 20 is pivotally disposed at one side of the base 50, and the second member 30 is pivotally disposed at the other side of the base 50. That is, the second member 30 is movably combined to the first member 20. The first member 20 has a ⊓-shaped operating slot 21. The first member 20 has a notch 22 adjacent to the operating slot 21, and the notch 22 covers the space area extending from the opening of the operating slot 21 to the edge of the first member. The first member 20 further has two retaining portions 23 and a ground portion 24. The retaining portions 23 are disposed on one side of the operating slot 21. The ground portion 24 is disposed on the other side of the operating slot 21 and on the outer surface of the first member 20. In addition, a ground wire 19 is inserted in the ground portion 24 for grounding.

Referring to FIGS. 2 to 6, the second member 30 has a restraining portion 31 and two bumps 32. The restraining portion 31 is disposed on the other end of the second member 30 opposite to the pivoting end. The bumps 32 are respectively disposed on the outer surface at two sides of the second member 30. When the terminal pressing member 52 disposed with the wires 171 rests on the piercing terminal block 51 of the base 50, the second member 30 rotates toward the piercing terminal block 51 to press the terminal pressing member 52, such that the wires 171 on the terminal pressing member 52 are embedded in the corresponding IDC terminals on the piercing terminal block 51. Thus, the wires 171 are electrically connected to the contact terminals inside the base 50 through the IDC terminals of the piercing terminal block 51, and the cable 17 is thus electrically connected to the cable 18. When the second member 30 is combined with the first member 20, the retaining portions 23 of the first member 20 grasp the bumps of the second member 30, so that the first member 20 and the second member 30 are firmly engaged together.

The clamping component 60, movably disposed in the operating slot 21 of the first member 20, includes a clamping member 61 and two elastic members 62. The clamping member 61 is movably disposed in the operating slot 21. That is, the size of the operating slot 21 is slightly larger than that of the clamping member 61, and thus the clamping member 61 is able to slide in the operating slot 21. The clamping member 61 has a pressing portion 611 and two sliding portions 612. The pressing portion 611 is connected between the sliding portions 612, and the sliding portions 612 extend into the operating slot 21 so as to guide the clamping member 61 to slide in the operating slot 21. The two ends of each elastic member 62 respectively rest on the bottom of the operating slot 21 and the clamping member 61, and the elastic member 62 may be, but not limited to, a compression spring. Normally, the elastic members 62 push against the clamping member 61 outward the operating slot 21, so that the pressing portion 611 may extend from the operating slot 21 into the notch 22.

Referring to FIGS. 2 to 6, the second member 30 and the first member 20 pivotally rotate relative to each other so as to be combined on one side of the base 50, thus forming a clamping area 70 corresponding to the operating slot 21. In practice, when the second member 30 is combined with the first member 20, the restraining portion 31 of the second member 30 extends into the notch 22 of the first member 20 to contact the ground wire mesh 172 of the cable 17, and the clamping area 70 is enclosed by the edges of the restraining portion 31 of the second member 30 and the notch 22 of the first member 20. The second member 30 and the first member 20 respectively rotate (or are lifted to rotate) toward the piercing terminal block 51 so as to be combined together and further cover the piercing terminal block 51, the front end of the cable 17, and the terminal pressing member 52. Thus, the cable 17 seems to pass through the clamping area 70 and extend between the first member 20 and the second member 30.

Normally, the clamping component 60 extends into the clamping area 70 to press against the cable 17, such that the second member 30 and the clamping component 60 together grip the cable 17 and keep in close contact with the ground wire mesh 172 of the cable 17. That is, the elastic members 62 normally push the clamping member 61 out of the operating slot 21, and thus the pressing portion 611 of the clamping member 61 may press against the cable 17 and keep in close contact with the ground wire mesh 172. Further, as the first member 20 is firmly engaged with the second member 30, the restraining portion 31 of the second member 30 presses against the cable 17 and keeps in close contact with the ground wire mesh 172. In addition, the ground wire 19 is electrically connected to the ground wire mesh 172 of the cable 17 through the first member 20 and the clamping component 60, so the cable 17 is grounded and fixed. Therefore, as long as the second member 30 is adopted to press against the terminal pressing member 52, and the first member 20 is then combined with the second member 30, the first member 20 and the second member 30 may grip the cable 17, and the cable 17 is further grounded via the ground wire 19.

Figure 7:
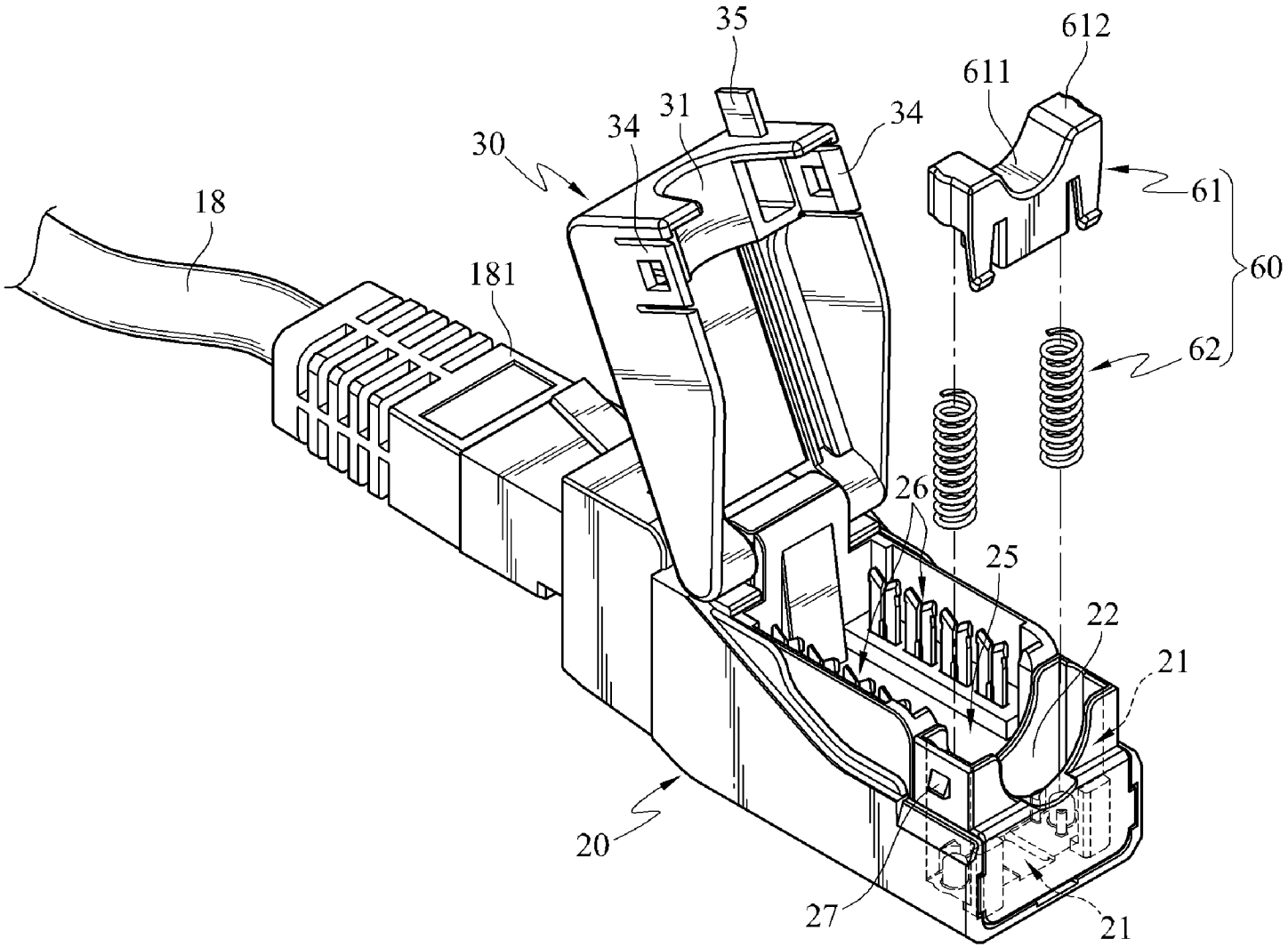
FIG. 7 is a three-dimensional exploded view of a signal jack according to a second embodiment of the present invention.
Figure 8:
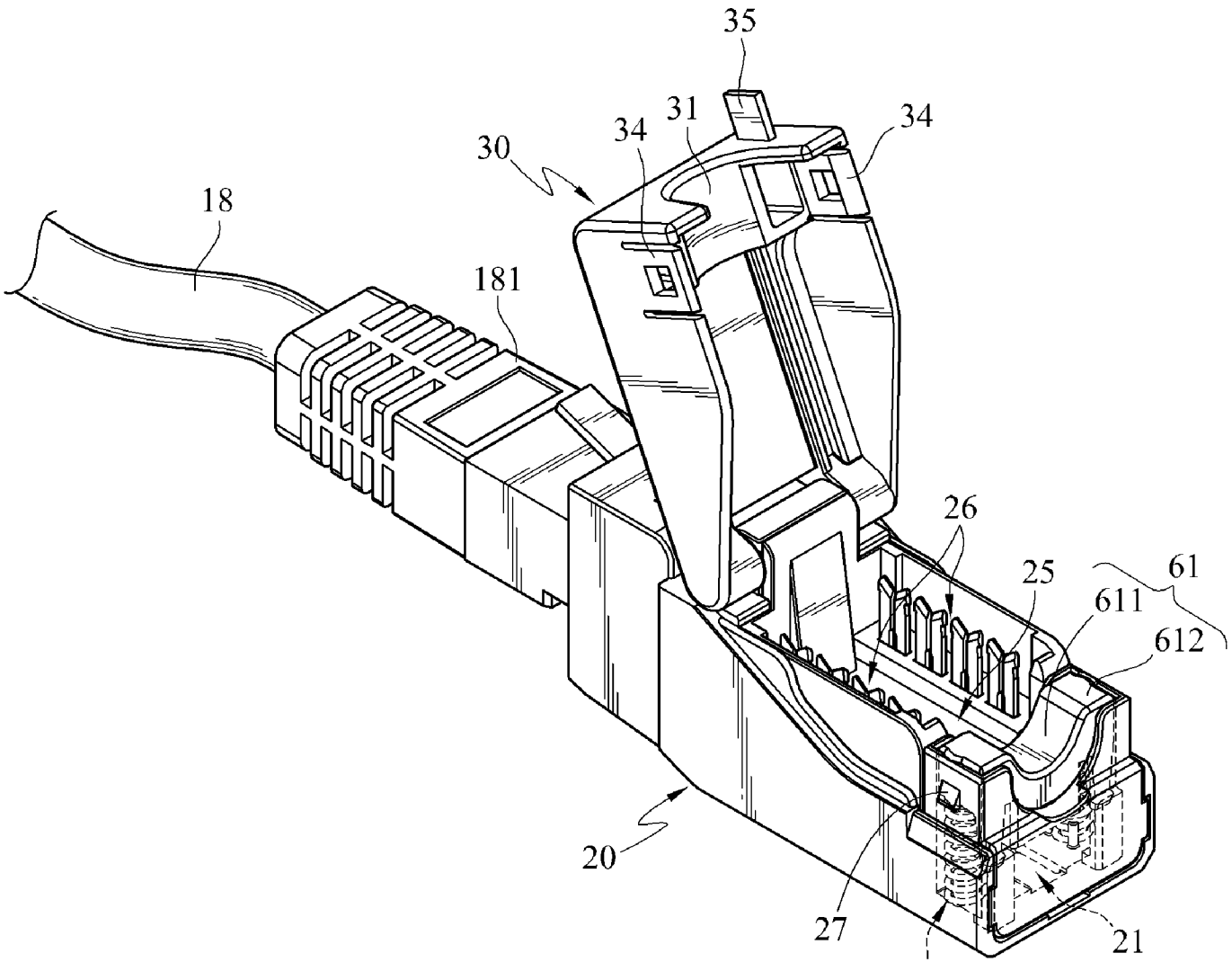
FIG. 8 is a schematic three-dimensional view of the signal jack according to the second embodiment of the present invention.
Figure 9:
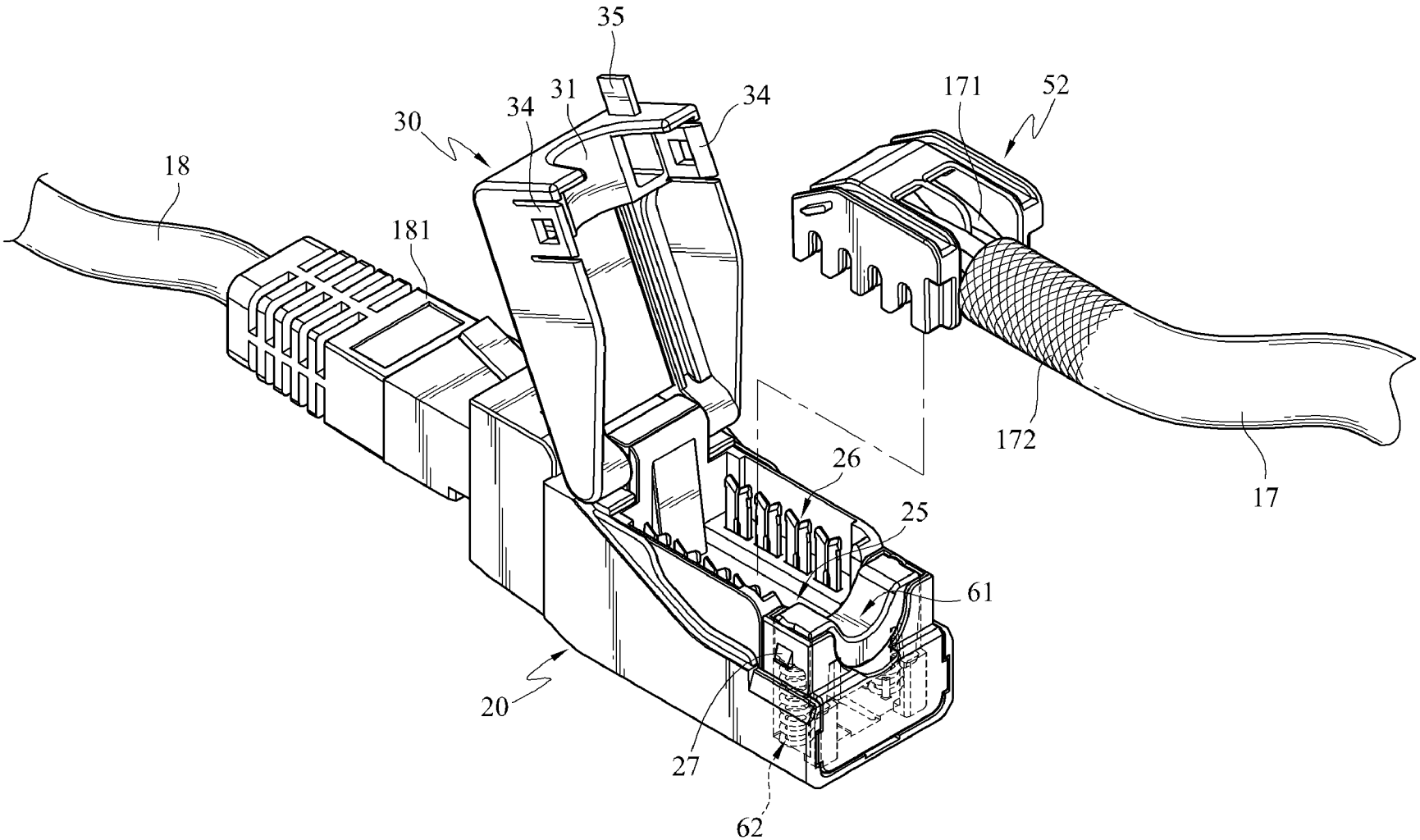
FIG. 9 is a three-dimensional assembly view of the signal jack and cables according to the second embodiment of the present invention.
Figure 10:
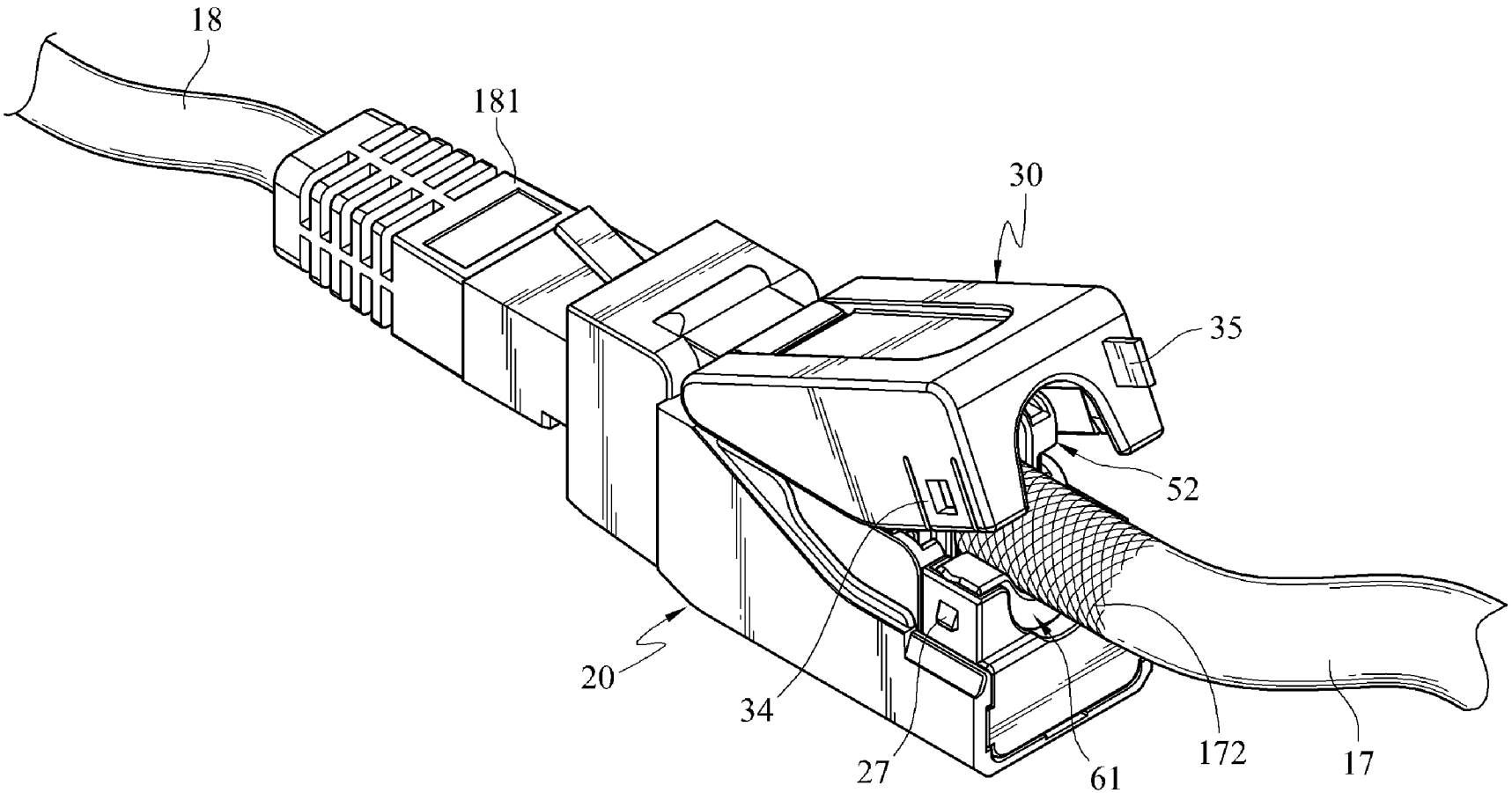
FIG. 10 is a three-dimensional assembly view of the signal jack and cables according to the second embodiment of the present invention.
Figure 11:
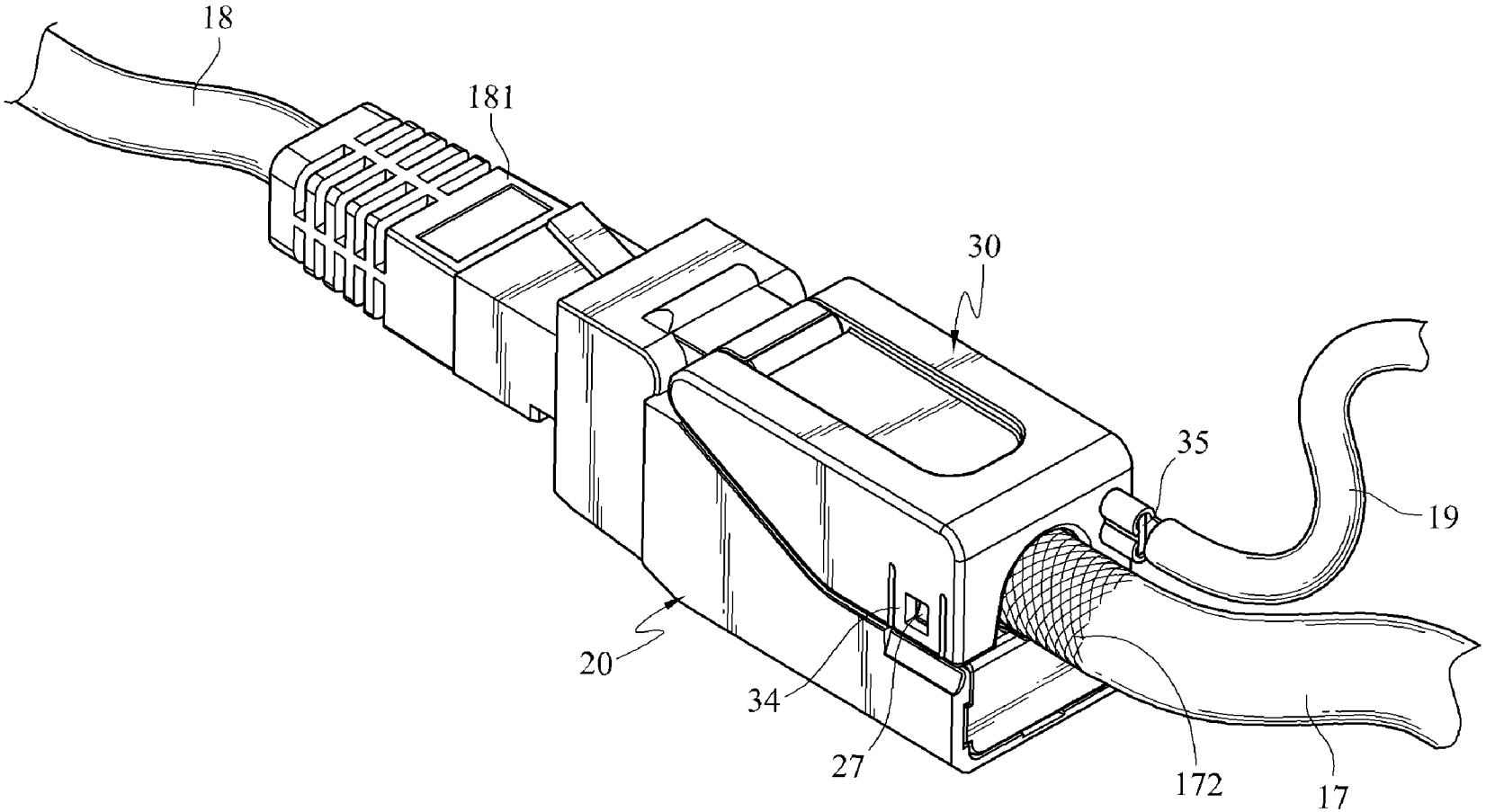
FIG. 11 is a three-dimensional combined view of the signal jack and cables according to the second embodiment of the present invention.
Figure 12:
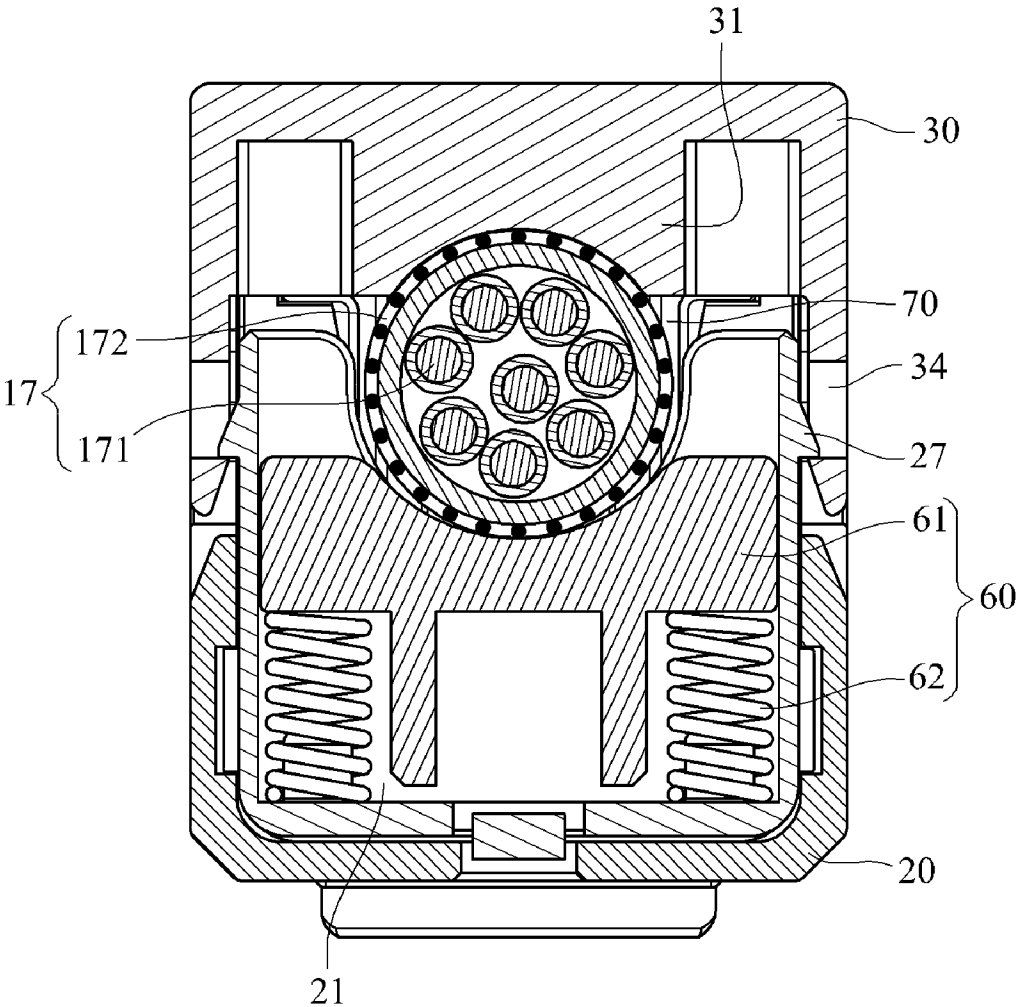
FIG. 12 is a schematic cross-sectional view of the signal jack and cables according to the second embodiment of the present invention.

Referring to FIGS. 7 to 12, a second embodiment of the present invention is shown. The objective and principle of this embodiment are similar to those of the first embodiment, so the details will not be repeated herein again, and only the differences will be illustrated below.

Referring to FIGS. 7, 8, 9, 10, and 11, the second member 30 is pivotally disposed at one side of the first member 20, and the second member 30 pivotally rotates about the first member 20 so as to be combined with the first member 20. The first member 20 has an operating slot 21, a chamber 25, and a piercing terminal block 26. The chamber 25 is located beside the operating slot 21. The piercing terminal block 26 is disposed in the chamber 25, so as to be combined with the exposed wires 171 at the front end of the cable 17. The second member 30 rotates toward the piercing terminal block 26, so as to be combined with the first member 20 and further cover the piercing terminal block 26, the chamber 25, and the front end of the cable 17. The exposed wires 171 at the front end of the cable 17 are disposed on the terminal pressing member 52, and the second member 30 rotates toward the piercing terminal block 26 to press against the terminal pressing member 52. Thus, the wires 171 are embedded in the IDC terminals of the piercing terminal block 26, and thus electrically connected to the cable 18.

The first member 20 has two bumps 27, and the second member 30 has two retaining portions 34. When the second member 30 is combined with the first member 20, the retaining portions 34 of the second member 30 grasp the bumps 27 of the first member 20, so that the first member 20 and the second member 30 are firmly engaged together. Further, the second member 30 has a restraining portion 31 and a ground portion 35. The restraining portion 31 and the clamping component 60 together grip the cable 18, and the ground portion 35 is inserted by the ground wire 19.

Referring to FIGS. 7 to 12, the second member 30 pivotally rotates to be combined with the first member 20, thus forming a clamping area 70 corresponding to the operating slot 21. In practice, when the second member 30 is combined with the first member 20, the restraining portion 31 of the second member 30 extends into the notch 22 of the first member 20 to contact the ground wire mesh 172 of the cable 17, and the clamping area 70 is enclosed by the edges of the restraining portion 31 of the second member 30 and the notch 22 of the first member 20. The second member 30 rotates (or is lifted to rotate) toward the piercing terminal block 26 and the chamber 25 so as to be combined with the first member 20 and together cover the piercing terminal block 26, the chamber 25, the front end of the cable 17, and the terminal pressing member 52. Thus, the cable 17 seems to pass through the clamping area 70 and extend between the first member 20 and the chamber 25.

Normally, the clamping component 60 extends into the clamping area 70 to press against the cable 17, such that the second member 30 and the clamping component 60 together grip the cable 17 and keep in close contact with the ground wire mesh 172 of the cable 17. That is, the elastic members 62 normally push the clamping member 61 out of the operating slot 21, and thus the pressing portion 611 of the clamping member 61 may press against the cable 17 and keep in close contact with the ground wire mesh 172. Further, as the first member 20 is firmly engaged with the second member 30, the restraining portion 31 of the second member 30 presses against the cable 17 and keeps in close contact with the ground wire mesh 172. In addition, the ground wire 19 is electrically connected to the ground wire mesh 172 of the cable 17 through the second member 30, so the cable 17 is grounded and fixed. Therefore, as long as the second member 30 is adopted to press against the terminal pressing member 52, and the first member 20 is then combined with the second member 30, the first member 20 and the second member 30 may grip the cable 17, and the cable 17 is further grounded via the ground wire 19.

In the communication jack provided by the embodiments of the present invention, as long as the first member is combined with the second member, the cable can be fixed and grounded, thus simplifying the assembly process, shortening the labor time, and reducing the operating space. Besides, as the clamping component is integrated inside the communication jack, the first member and the second member may provide certain protections to resist external forces. Thus, additional parts can be reduced, and problems that the parts fall apart or get lost can be solved.

What is claimed is:

1. A communication jack, adapted to connect a cable that has a ground wire mesh laid on a surface of the cable from inner to outer, the communication jack comprising:

a first member, having an operating slot;

a second member, movably assembled with the first member, wherein the second member and the first member pivotally rotate relatively so as to be combined together to form a clamping area corresponding to the operating slot, and the cable passes through the clamping area and extends into a place between the first member and the second member; and a clamping component, displacedly disposed in the operating slot, wherein the clamping component normally extends into the clamping area to press against the cable, such that the second member and the clamping component work together to grip the cable and keep in contact with the ground wire mesh;

wherein the second member is pivotally disposed on one side of the first member, the first member having a piercing terminal block provided so as to be assembled to the front end of the cable, and wherein the second member rotates towards the piercing terminal block so as to combine with the first member and cover the piercing terminal block and the front end of the cable;

wherein the first member has a chamber located beside the operating slot, the piercing terminal block is disposed in the chamber, and the front end of the cable passes through the clamping area and extends into the chamber.

2. The communication jack according to claim 1, wherein the first member has a notch adjacent to the operating slot, the second member has a restraining portion, the restraining portion extends into the notch to contact the ground wire mesh of the cable, and the clamping area is enclosed by the edges of the restraining portion and the notch.

3. The communication jack according to claim 1, wherein the clamping component comprises a clamping member and at least one elastic member, the clamping member is displacedly disposed in the operating slot, the two ends of the elastic member respectively rest on the bottom of the operating slot and the clamping member so as to normally push the clamping member in a direction towards the outside of the operating slot, and thus the clamping member presses against the cable and keeps in contact with the ground wire mesh.

4. The communication jack according to claim 3, wherein the clamping member has a pressing portion and two sliding portions, the sliding portions extend into the operating slot so as to guide the clamping member to slide in the operating slot, and the pressing portion is connected between the sliding portions and is normally pushed out of the operating slot to press against the cable and keep in contact with the ground wire mesh.

5. The communication jack according to claim 1, wherein the second member has at least one bump, the first member has at least one retaining portion, and the retaining portion holds the bump, so that the first member and the second member are engaged together.

6. The communication jack according to claim 1, wherein the first member has a ground portion provided for insertion of a ground wire, and the ground wire is electrically connected to the ground wire mesh of the cable through the first member and the clamping component.

7. The communication jack according to claim 1, further comprising a terminal pressing member, wherein the cable has a plurality of wires wrapped by the ground wire mesh and exposed out of the front end of the cable and disposed on the terminal pressing member, the second member rotates towards the piercing terminal block to press the terminal pressing member, and thus the wires are embedded into the piercing terminal block.

8. The communication jack according to claim 1, wherein the first member has at least one bump, the second member has at least one retaining portion, and the retaining portion grasps the bump, so that the first member and the second member are firmly engaged together.

9. The communication jack according to claim 1, wherein the second member has a ground portion provided for insertion of a ground wire, and the ground wire is electrically connected to the ground wire mesh of the cable through the second member.

* * * * *